US008851126B1

(12) United States Patent
Spikes et al.

(10) Patent No.: US 8,851,126 B1
(45) Date of Patent: Oct. 7, 2014

(54) WIRE LOADING MAGAZINE FOR TWIST ATTACHMENT DEVICE

(76) Inventors: Larry W. Spikes, Marshall, TX (US); Damon Johnston, Land O'Lakes, FL (US)

( * ) Notice: Subject to any disclaimer, the term of this patent is extended or adjusted under 35 U.S.C. 154(b) by 826 days.

(21) Appl. No.: 13/068,175

(22) Filed: May 4, 2011

(51) Int. Cl.
*B21F 33/00* (2006.01)
*B21F 15/04* (2006.01)

(52) U.S. Cl.
USPC ..... 140/57; 140/119

(58) Field of Classification Search
CPC ..... B21F 7/00; B21F 15/00; B21F 15/02; B21F 15/04; B21F 23/00; B21F 23/005; B21F 25/00; B21F 33/00
USPC ..... 140/57, 58, 59, 117, 118, 119
See application file for complete search history.

(56) References Cited

U.S. PATENT DOCUMENTS

| | | | | |
|---|---|---|---|---|
| 356,638 | A | 1/1887 | Haag | |
| 595,623 | A | 12/1897 | Guthrie | |
| 619,355 | A | 2/1899 | Scofield | |
| 1,978,164 | A * | 10/1934 | Van Inwagen, Jr. et al. | 140/113 |
| 3,031,170 | A * | 4/1962 | Ingram | 256/57 |
| 3,524,481 | A * | 8/1970 | Lee et al. | 140/93.6 |
| 3,650,302 | A | 3/1972 | Palms | |
| 4,413,660 | A | 11/1983 | Conrad | |
| 7,290,570 | B1 | 11/2007 | Spikes | |
| 2006/0243340 | A1 * | 11/2006 | Wheeler et al. | 140/57 |

* cited by examiner

*Primary Examiner* — Teresa M Ekiert
(74) *Attorney, Agent, or Firm* — R. Keith Harrison

(57) ABSTRACT

A wire loading magazine for a twist attachment device includes a magazine assembly adapted to carry a supply of attachment wire segments and a wire loading assembly carried by the magazine assembly and adapted to individually and sequentially load the attachment wire segments from the magazine assembly into the twist attachment device.

18 Claims, 7 Drawing Sheets

WIRE LOADING MAGAZINE FOR TWIST ATTACHMENT DEVICE

FIELD

The disclosure generally relates to wire fences such as barbed-wire fences which include runs of wire that are attached to fence posts inserted in the ground. More particularly, the disclosure relates to a wire loading magazine which loads attachment wire segments into a twist attachment device that is suitable for attaching barbed wire to a fence post by wrapping an attachment wire segment around the barbed wire on opposite sides of the fence post with the fence post interposed between the attachment wire segment and the barbed wire.

BACKGROUND

Barbed wire fences are widely used to define boundaries on land areas for the purpose of keeping livestock or other animals inside the fenced-in areas and keeping predatory animals or unauthorized personnel out of the areas. Typically, a barbed wire fence includes multiple vertically-spaced horizontal runs of barbed wire which are supported at spaced intervals by vertical fence posts extending from the ground. Conventionally, each of the barbed wire segments is attached to each fence post typically using clips which engage the barbed wire and the fence post. Because these clips must be individually inserted in place on the fence posts, construction of a barbed wire fence is a time-consuming and labor-intensive undertaking.

A twist attachment device which attaches runs of wire to fence posts by wrapping an attachment wire segment around the wire on opposite sides of the fence post is disclosed in U.S. Pat. No. 7,290,570. A wire loading magazine which loads attachment wire segments into a twist attachment device that is suitable for attaching barbed wire to a fence post is needed.

SUMMARY

The disclosure is generally directed to a wire loading magazine for a twist attachment device. An illustrative embodiment of the wire loading magazine includes a magazine assembly adapted to carry a supply of attachment wire segments and a wire loading assembly carried by the magazine assembly and adapted to individually and sequentially load the attachment wire segments from the magazine assembly into the twist attachment device.

BRIEF DESCRIPTION OF THE DRAWINGS

The disclosure will now be made, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
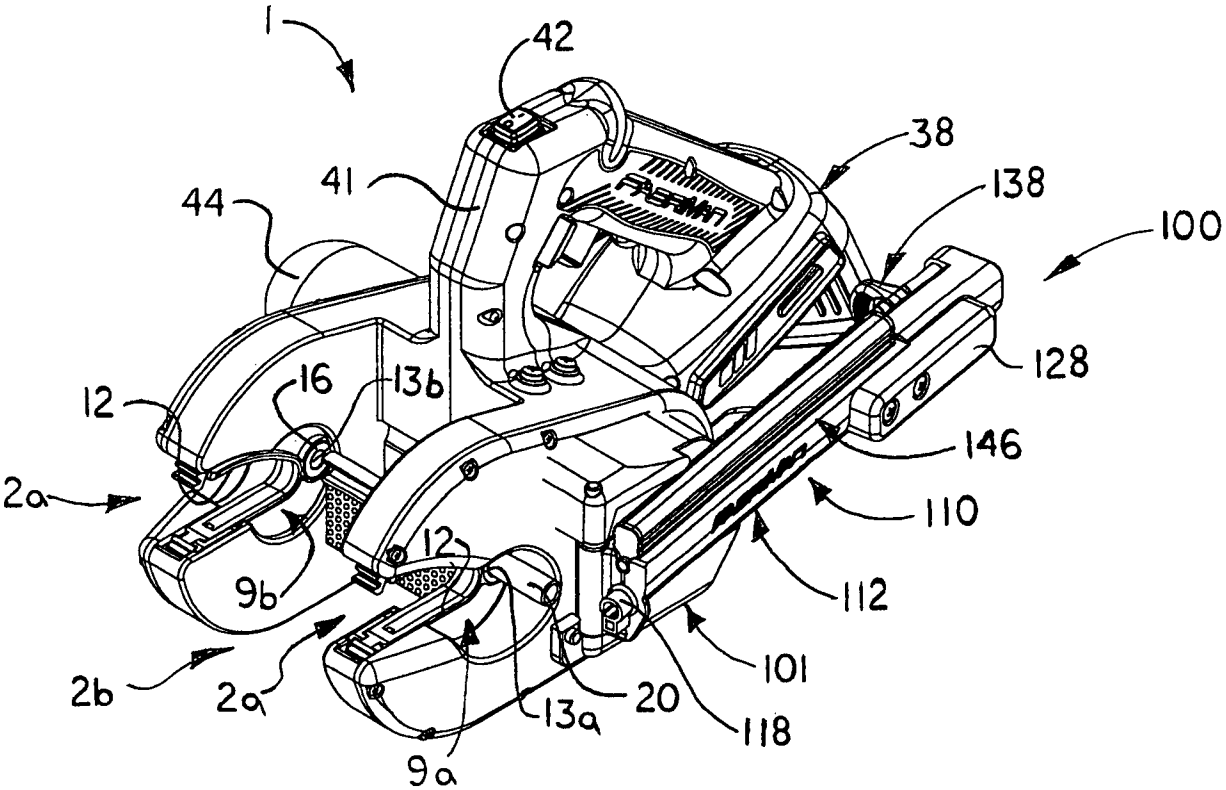
FIG. 1 is a front perspective view of a twist attachment device with an illustrative embodiment of the wire loading magazine on the device and deployed in a closed or stowed position.
Figure 2:
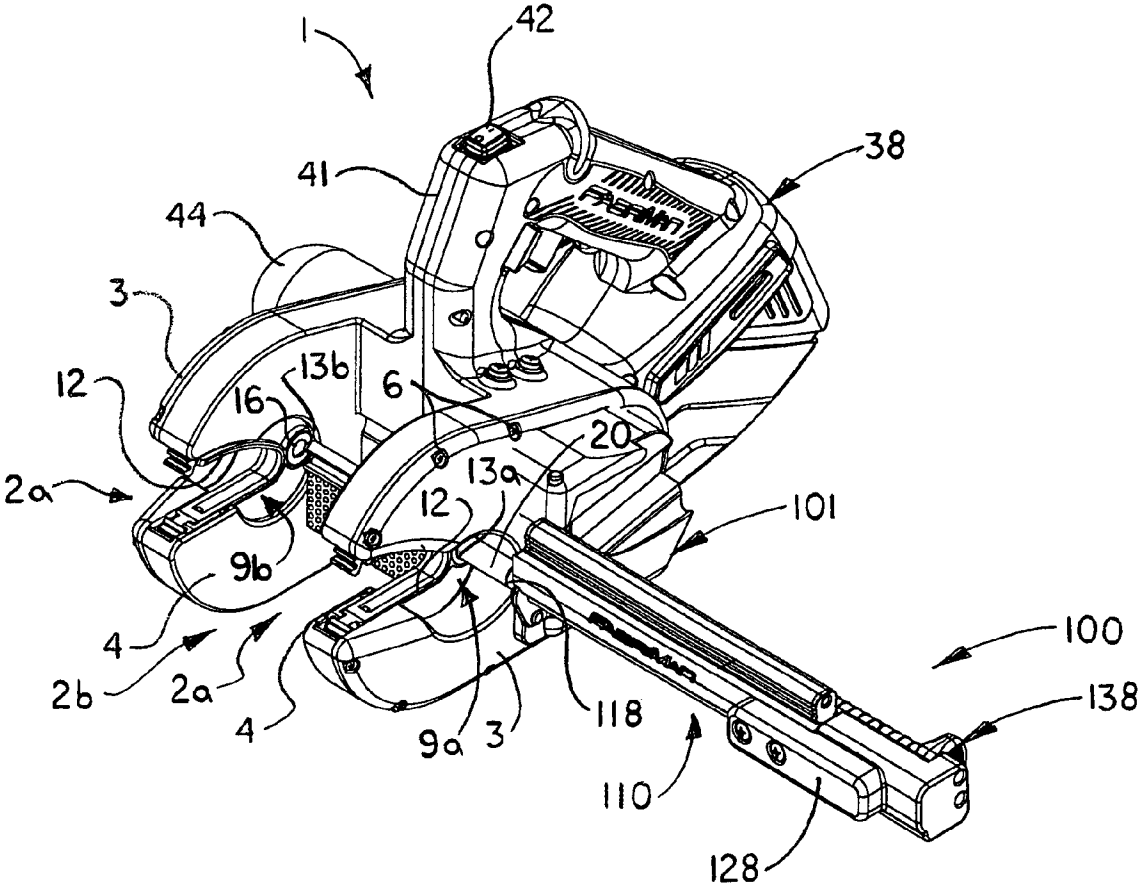
FIG. 2 is a front perspective view of the twist attachment device with the wire loading magazine deployed in an open or functional position.

Referring initially to FIGS. 1 and 2 of the drawings, an illustrative embodiment of the wire loading magazine for twist attachment device, hereinafter magazine, is generally indicated by reference numeral 100. The magazine 100 is adapted to interface with a twist attachment device 1 which is operable to attach barbed wire (not illustrated) to a fence post (not illustrated) by wrapping an attachment wire segment (not illustrated) around the barbed wire on opposite sides of the fence post with the fence post interposed between the attachment wire segment and the barbed wire. Examples of twist attachment devices 1 which are suitable for implementation of the magazine 100 are disclosed in U.S. Pat. No. 7,290,570, which is incorporated by reference herein in its entirety. Generally, the twist attachment device 1 may include a frame (not illustrated) having a pair of spaced-apart, generally V-shaped frame plate notches 2*a* and a frame space 2*b* extending between the frame plate notches 2*a*. A device housing 38 may be supported by the frame. A pair of twist gears 9*a* and 9*b*, respectively, may be mounted for rotation on the frame inside the device housing 38 at the respective frame plate notches 2*a*. Each twist gear 9*a* and 9*b* may include a generally V-shaped wire notch 12 and a wire opening 13*a* and 13*b* which extends transversely through the corresponding twist gear 9*a*, 9*b*, generally adjacent to the apex of the wire notch 12 and offset with respect to the geometric center of the twist gear 9*a*, 9*b*. Upon rotation of the twist gears 9*a* and 9*b* on the frame, the wire notch 12 of each twist gear 9*a*, 9*b* periodically and regularly coincides in position and aligns with the corresponding like-shaped frame plate notch 2*a*.

A motor 44 having a battery or other power supply (not illustrated) may be provided on the interior or the exterior, as illustrated, of the device housing 38. The motor 44 may drivingly engage the twist gears 9*a*, 9*b* through a gear assembly (not illustrated) for rotation inside the device housing 38 such as in the manner which is described in U.S. Pat. No. 7,290,570. A handle 41 may also be provided on the device housing 38. A finger-actuated trigger 42 may be provided on the handle 41 and electrically connected to the motor 44 and the battery or other power supply (not illustrated) to operate the motor 44 according to the knowledge of those skilled in the art.

In some embodiments of the twist attachment device 1, a wire segment guide conduit 20 may extend through the wire opening 13*a* of the twist gear 9*a* and terminate at the wire opening 13*b* of the twist gear 9*b*. An annular transfer gear magnet 16 may be provided in the wire opening 13*b* of the twist gear 9*b*. The purpose of the wire segment guide conduit 20 and the transfer gear magnet 16 will be hereinafter described.

Figure 3:
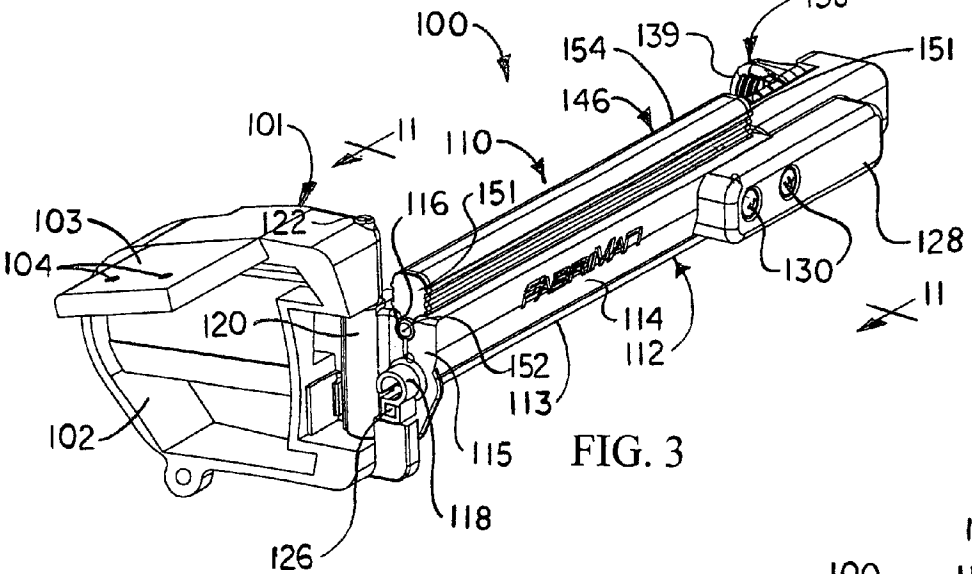
FIG. 3 is a front perspective view of an illustrative embodiment of the wire loading magazine detached from the twist attachment device (not illustrated)

Referring next to FIGS. 3-14 of the drawings, the magazine 100 may include a magazine mount bracket 101. As illustrated in FIG. 3, the magazine mount bracket 101 may include a mount bracket body 102. The mount bracket body 102 of the magazine mount bracket 101 may be adapted for attachment to the device housing 38 (FIGS. 1 and 2) of the twist attachment device 1 according to any suitable attachment technique which is known by those skilled in the art. In some embodiments, the mount bracket body 102 may include a mount bracket flange 103. At least one flange fastener opening 104 may extend through the mount bracket flange 103. Accordingly, the mount bracket flange 103 may be attached to the device housing 38 of the twist attachment device 1 by extending flange fasteners (not illustrated) through the respective flange fastener openings 104 and threading the flange fasteners into respective registering fastener openings (not illustrated) in the device housing 38. Alternative attachment techniques and methods known by those skilled in the art may be used to attach the mount bracket body 102 of the magazine 100 to the device housing 38 of the twist attachment device 1. For example and without limitation, in some embodiments the mount bracket body 102 may be fabricated in one piece with the device housing 38 using to molding or casting techniques known by those skilled in the art.

Figure 5:
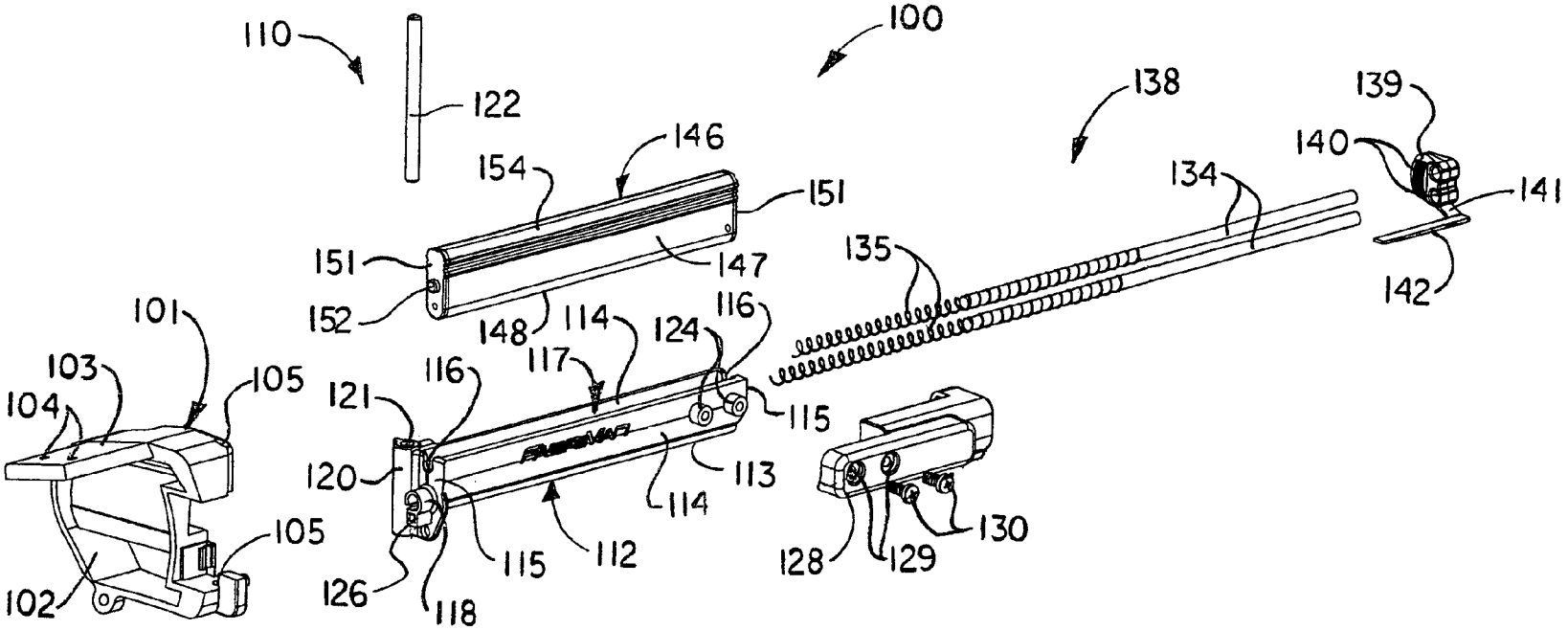
FIG. 5 is an exploded perspective view of an illustrative embodiment of the wire loading magazine.
Figure 7:
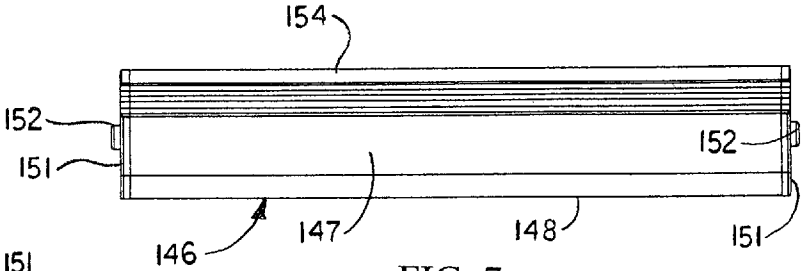
FIG. 7 is a side view of the wire loading clip.
Figure 6:
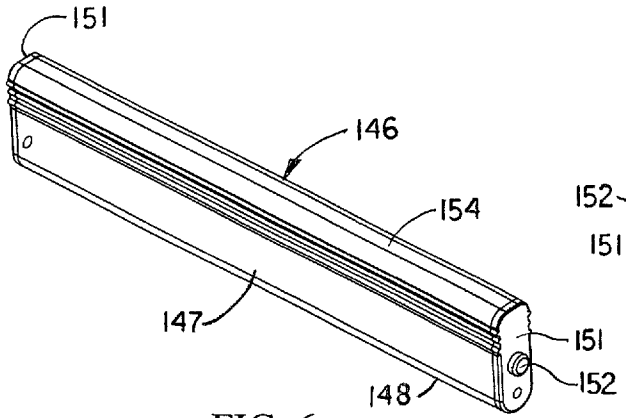
FIG. 6 is a perspective view of a wire loading clip component of an illustrative embodiment of the wire loading magazine.
Figure 9:
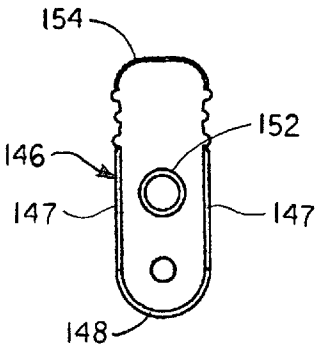
FIG. 9 is an end view of the wire loading clip.

A magazine assembly 110 may be supported by the magazine mount bracket 101. As illustrated in FIGS. 3 and 5, the magazine assembly 110 may include a generally elongated clip trough 112. The clip trough 112 may include a clip trough bottom 113, a pair of spaced-apart clip trough side walls 114 extending from the clip trough bottom 113 and a pair of clip trough end walls 115 at the respective opposite ends of the clip trough bottom 113 and the clip trough side walls 114. A generally elongated clip trough interior 117 may be defined by and between the clip trough bottom 113, the clip trough side walls 114 and the clip trough end walls 115. As illustrated in FIG. 5, in some embodiments, a generally U-shaped clip notch 116 may be provided in each clip trough side wall 114 for purposes which will be hereinafter described. As illustrated in the cross-sectional views of FIGS. 11 and 12, a generally elongated stanchion slot 119 (illustrated in cross-section) may extend through and along at least a portion of one of the clip trough side walls 114 generally at the clip trough bottom 113 for purposes which will be hereinafter described. As illustrated in FIG. 5, in some embodiments, a wire segment guide 118, the purpose of which will be hereinafter described, may extend from a clip trough end wall 115 of the clip trough 112. The wire segment guide 118 communicates with the clip trough interior 117. As illustrated in FIG. 3, in some embodiments, a wire segment stabilizing magnet 126 may be provided in the wire segment guide 118 for purposes which will be hereinafter described.

The clip trough 112 of the magazine assembly 110 may be attached to the mount bracket body 102 of the magazine mount bracket 101 using any suitable attachment technique which is known by those skilled in the art. As illustrated in FIG. 5, in some embodiments, a hinge pin receptacle 120 having a receptacle opening 121 may be provided on a clip trough end wall 115 of the clip trough 112 generally adjacent to the wire segment guide 118. A pair of spaced-apart hinge pin openings 105 may be provided in the mount bracket body 102 of the magazine mount bracket 101. Accordingly, the hinge pin receptacle 120 of the clip trough 112 may be inserted between the hinge pin openings 105 in the magazine mount bracket 101. A hinge pin 122 may be extended through the hinge pin openings 105 in the magazine mount bracket 101 and through the registering receptacle opening 121 in the hinge pin receptacle 120 to pivotally attach the clip trough 112 to the magazine mount bracket 101. Therefore, the magazine assembly 110 may be capable of selectively pivoting with respect to the device housing 38 of the twist attachment device 1 between the stowed or storage position illustrated in FIG. 1 and the extended, functional position illustrated in FIG. 2 for purposes which will be hereinafter described. In alternative illustrative embodiments, the clip trough 112 may be attached to the magazine mount bracket 101 using fasteners (not illustrated) or other attachment technique or may be fixed or fabricated in one piece with the magazine mount bracket 101.

Figure 10:
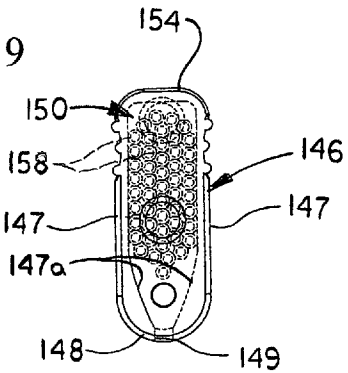
FIG. 10 is an end view of the wire loading clip, with a supply of wire segments (illustrated in phantom) contained in the clip.
Figure 8:
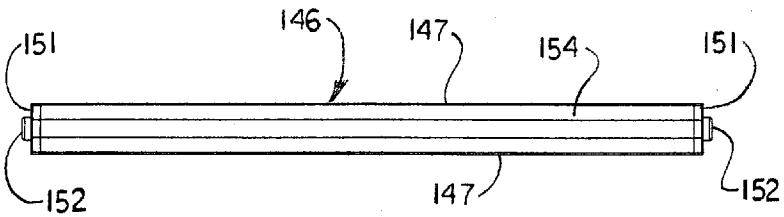
FIG. 8 is a top view of the wire loading clip.
Figure 11:
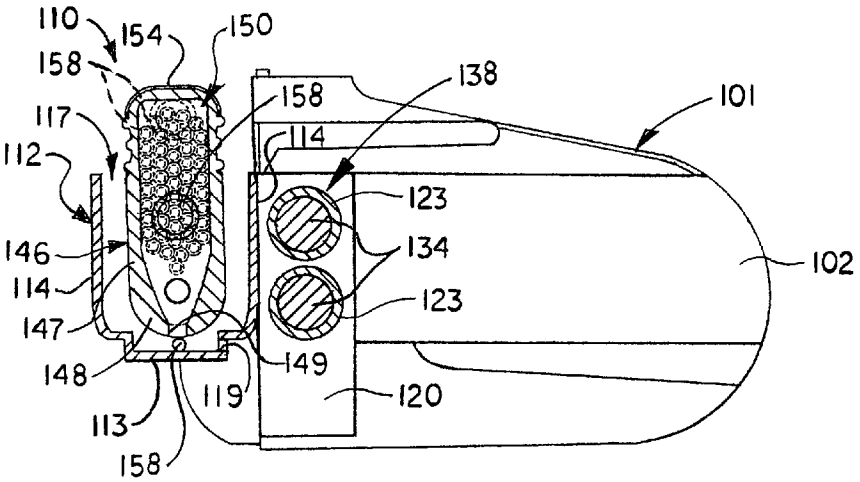
FIG. 11 is a sectional view, taken along section lines 11-11 in FIG. 3.
Figure 12:
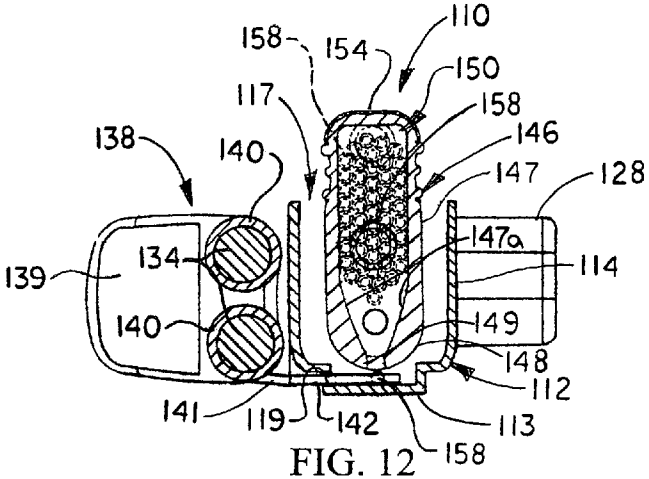
FIG. 12 is a sectional view, taken along section lines 12-12 in FIG. 4.

A wire loading clip 146 may be inserted into the clip trough interior 117 of the clip trough 112. The wire loading clip 146 may include a clip bottom portion 148, a pair of spaced-apart clip trough side walls 147 extending from the clip bottom portion 148 and a pair of clip end walls 151 at opposite ends of the clip bottom portion 148 and the clip side walls 147. A generally elongated clip interior 150 (FIG. 10) may be defined by and between the clip bottom portion 148, the clip side walls 147 and the clip end walls 151. As illustrated in FIG. 10, the clip interior 150 is sized and configured to contain a supply of attachment wire segments 158 (illustrated in phantom). As further illustrated in FIG. 10, a generally elongated wire segment dispensing slot 149 may be provided in the clip bottom portion 148 of the wire loading clip 146 and disposed in communication with the clip interior 150. Therefore, as illustrated in FIGS. 11 and 12, the attachment wire segments 158 individually and sequentially fall from the clip interior 150 through the wire segment dispensing slot 149 and onto the clip trough bottom 113 in the clip trough interior 117 of the clip trough 112. The interior wall surfaces 147*a* of the clip bottom portion 148 in the lower portion of the clip interior 150 may have a generally tapered or funnel-shaped cross-section. The wire loading clip 146 may include a clip cover 154 which in some embodiments may be detachably provided on the clip side walls 147 and the clip end walls 151 for selective removal there from. In other embodiments, the clip cover 154 may be pivotally attached to one of the clip side walls 147.

As further illustrated in FIG. 5, the wire loading clip 146 may be removably inserted in the clip trough interior 117 of the clip trough 112. Accordingly, in some embodiments, a clip notch 116 may be provided in each clip trough end wall 115 of the clip trough 112. A clip tab 152 may be provided on the exterior surface of each clip end wall 151. Therefore, the wire loading clip 146 may be secured in the clip trough interior 117 of the clip trough 112 by inserting the clip tabs 152 on the wire loading clip 146 into the clip notches 116 provided in the respective clip end walls 151. In other embodiments, the wire loading clip 146 may be secured or seated in the clip trough interior 117 using alternative techniques known by those skilled in the art. In some embodiments, the wire loading clip 146 may be fixedly mounted in the clip trough interior 117 and/or fabricated in one piece with the clip trough 112.

The magazine assembly 110 may be fitted with a wire loading assembly 138 which facilitates loading or dispensing of attachment wire segments 158 (FIG. 10) from the wire loading clip 146 into the twist attachment device 1 typically in a manner which will be hereinafter described. In some embodiments, the wire loading assembly 138 may include at least one generally elongated guide rod 134 and an assembly return spring 135 on the guide rod 134. In some embodiments, the wire loading assembly 138 may include a pair of generally elongated, parallel guide rods 134, as illustrated. The guide rods 134 may extend in generally parallel, adjacent relationship to the clip trough 112 of the magazine assembly 110.

Figure 4:
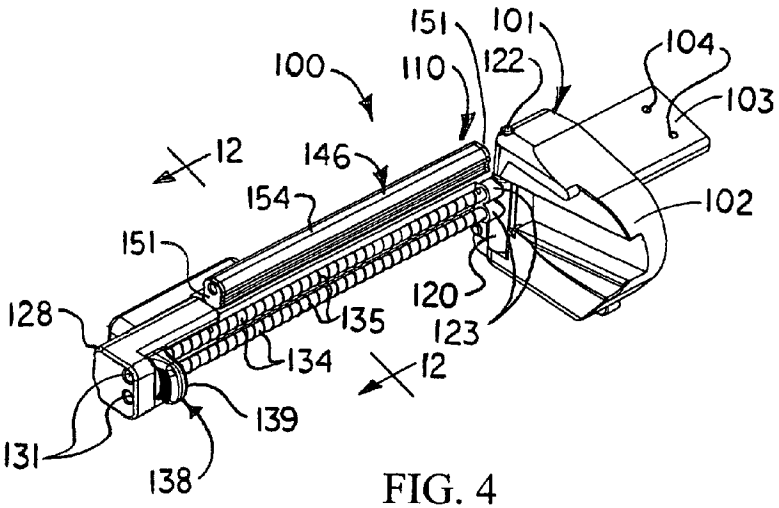
FIG. 4 is a rear perspective view of an illustrative embodiment of the wire loading magazine.

As illustrated in FIGS. 4 and 11, a first end (not numbered) of each guide rod 134 may be inserted in a corresponding rod mount collar 123. The rod mount collars 123 may be provided on the magazine mount bracket 101, the clip trough 112 or on any other suitable structural element. In some embodiments, the first ends of the respective guide rods 134 may be inserted into a pair of adjacent rod mount collars 123, respectively, on the hinge pin receptacle 120 of the clip trough 112. An assembly knob 139 may be slidably mounted along the guide rods 134. Accordingly, as illustrated in FIGS. 5 and 12, in some embodiments, a pair of rod openings 140 may extend through the assembly knob 139. The guide rods 134 may extend through the respective rod openings 140 to slidably mount the assembly knob 139 on the guide rods 134.

A wire loading assembly mount bracket 128 may be mounted on the clip trough 112. As illustrated in FIG. 4, the wire loading assembly mount bracket 128 may have at least one rod opening 131. The second ends (not numbered) of the respective guide rods 134 may be inserted into the respective rod openings 131 (FIG. 4) in the wire loading assembly mount bracket 128. As illustrated in FIG. 5, in some embodiments, the wire loading assembly mount bracket 128 may be attached to the clip trough 112 by extending fasteners 130 through a pair of respective fastener openings 129 in the wire loading assembly mount bracket 128 and threading the fasteners 130 into a registering pair of respective fastener bosses 124 provided on the clip trough 112.

As further illustrated in FIG. 5, a stanchion 141 may extend outwardly from the bottom portion of the assembly knob 139. A wire engaging member 142 may extend forwardly from the stanchion 141 in generally perpendicular relationship thereto. As illustrated in FIG. 12, the stanchion 141 may extend through the elongated stanchion slot 119 (which extends through and along the clip side wall 114) into the lower portion of the clip trough interior 117 of the clip trough 112. The wire engaging member 142 may be disposed in the clip trough interior 117 beneath the wire segment dispensing slot 149 in the clip bottom portion 148 of the wire loading clip 146.

Figure 13:
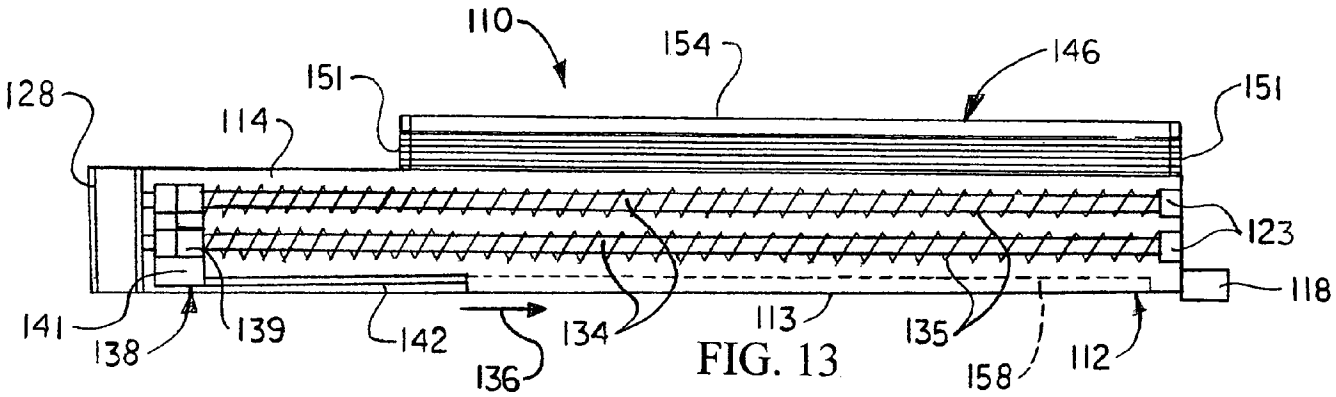
FIG. 13 is a side view of a magazine assembly portion of the wire loading magazine, with a wire loading assembly of the magazine deployed in a cocked position preparatory to inserting a wire segment (illustrated in phantom) into a twist attachment device (not illustrated)
Figure 14:
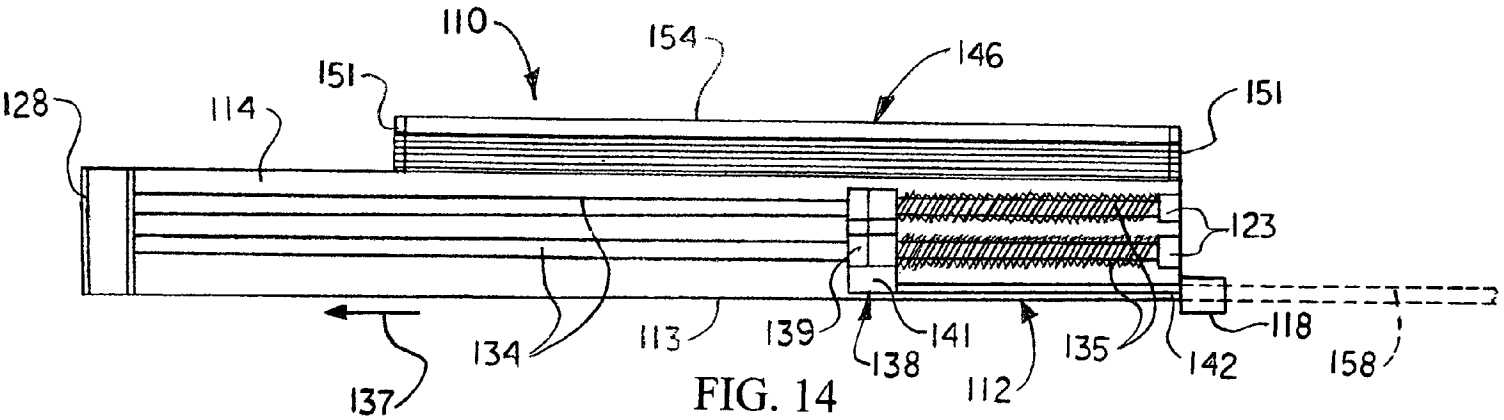
FIG. 14 is a side view of the magazine assembly portion of the wire loading magazine, with the wire loading assembly deployed in a wire insertion position in insertion of the wire segment (illustrated in phantom) into the twist attachment device (not illustrated).

As illustrated in FIG. 13, the assembly return springs 135 on the respective guide rods 134 normally engage and maintain the assembly knob 139 in a return position against or adjacent to the wire loading assembly mount bracket 128. The assembly knob 139 can be manually grasped and slid along the guide rods 134 away from the wire loading assembly mount bracket 128 in the direction indicated by the arrow 136 (FIG. 13) against the bias imparted by the assembly return springs 135. This action facilitates linear travel of the wire engaging member 142 in the clip trough interior 117 of the clip trough 112 also in the direction indicated by the arrow 136 in FIG. 13. Thus, the wire engaging member 142 pushes the attachment wire segment 158 (which was previously dispensed from the wire loading clip 146 through the wire segment dispensing slot 149, FIG. 11) from the clip trough interior 117 through the wire segment guide 118, as illustrated in FIG. 14. Upon subsequent release of the assembly knob 139, the assembly return springs 135 bias and return the assembly knob 139 back to the original return position (FIG. 13) against or adjacent to the wire loading assembly mount bracket 128 in the direction of the arrow 137 in FIG. 14.

Referring again to FIGS. 1, 2 and 11-14 of the drawings, in exemplary application of the magazine 100, the magazine mount bracket 101 is attached to the device housing 38 of the twist attachment device 1 in adjacent proximity to the twist gear 9*a* of the twist attachment device 1. Accordingly, the magazine assembly 110 may be capable of pivoting with respect to the magazine mount bracket 101 between the folded, stowed or storage position illustrated in FIG. 1 and the extended or functional position illustrated in FIG. 2. When the magazine assembly 110 is deployed in the extended position of FIG. 2, the wire segment guide 118 of the clip trough 112 aligns or registers with the wire segment guide conduit 20 of the twist attachment device 1.

As illustrated in FIGS. 11 and 12, a supply of attachment wire segments 158 (illustrated in phantom) is placed in the clip interior 150 of the wire loading clip 146. In some embodiments, the clip cover 154 may be detached from the wire loading clip 146 to facilitate placement of the attachment wire segments 158 in the clip interior 150. Accordingly, the attachment wire segments 158 fall into the tapered or funnel-shaped bottom portion of the clip interior 150. One of the attachment wire segments 158 falls from the clip interior 150 through the wire segment dispensing slot 149 and into a pre-loaded position on the clip trough bottom 113 in the clip trough interior 117 of the clip trough 112. The wire segment stabilizing magnet 126 (FIG. 3) stabilizes the position of the attachment wire segment 158 in the clip trough interior 117 such that the attachment wire segment 158 remains aligned with the wire segment guide 118.

The twist attachment device 1 may be operated to attach a run of barbed wire (not illustrated) to fence posts (not illustrated) using the attachment wire segments 158 in the manner which is described in U.S. Pat. No. 7,290,570. Accordingly, the frame space 2*b* (FIGS. 1 and 2) of the twist attachment device 1 receives the fence post to which the barbed wire is to be attached. The wire notches 12 of the respective twist gears 9*a*, 9*b* may be rotated into registration with the respective frame plate notches 2*a* by operation of the device motor 44 (typically via the trigger 42), after which the frame plate notches 2*a* and the wire notches 12 of the respective twist gears 9*a*, 9*b* receive the barbed wire which is to be attached to the fence post.

The attachment wire segment 158 is loaded from the preloaded position in the clip trough interior 117 of the clip trough 112 in the magazine 100 and pushed into place through the wire opening 13*a* of the twist gear 9*a* and the aligned wire opening 13*b* of the twist gear 9*b* as follows. The assembly knob 139 of the wire loading assembly 138 is manually slid on the guide rods 134 in the direction of the arrow 136 (FIG.

13) against the bias imparted by the assembly return springs 135. This action causes the wire engaging member 142 of the wire loading assembly 138 to engage and push the attachment wire segment 158 (illustrated in phantom in FIGS. 13 and 14) from the clip trough interior 117 of the clip trough 112 through the wire segment guide 118 and the wire segment guide conduit 20 (FIGS. 1 and 2), respectively. Therefore, the wire segment guide conduit 20 guides the attachment wire segment 158 into place through the wire opening 13*a* of the twist gear 9*a* and the registering wire opening 13*b* of the twist gear 9*b* of the twist attachment device 1. The transfer gear magnet 16 (FIGS. 1 and 2) in the wire opening 13*b* of the twist gear 9*b* may assist placement of the attachment wire segment 158 by magnetically drawing or pulling the attachment wire segment 158 through the wire segment guide conduit 20 and into place in the wire openings 13*a*, 13*b*. As the attachment wire segment 158 is loaded from the pre-loaded position in the clip trough interior 117 of the clip trough 112 into position through the wire openings 13*a*, 13*b* of the twist gears 9*a*, 9*b*, another attachment wire segment 158 falls from the clip trough interior 117 through the wire segment dispensing slot 149 (FIGS. 11 and 12) into the pre-loaded position in the bottom of the clip trough interior 117. The assembly knob 139 is released and the assembly return springs 135 return the assembly knob 139 to the position illustrated in FIG. 13 as indicated by the arrow 137 in FIG. 14.

The motor 44 of the twist attachment device 1 is then operated (typically by manual depression of the trigger 42) to rotate the twist gears 9*a* and 9*b*. As the device motor 44 rotates the twist gears 9*a* and 9*b*, the twist gears 9*a* and 9*b* wrap the attachment wire segment 158 around the run of barbed wire on respective sides of the fence post. Therefore, the attachment wire segment 158 secures the barbed wire to the fence post. Operation of the motor 44 is then terminated and the twist attachment device 1 is removed and repositioned at the next fence post in line for like attachment of the barbed wire to that fence post. Accordingly, the subsequent attachment wire segment 158 may be loaded from the pre-loaded position in the clip trough interior 117 of the clip trough 112 into place through the wire openings 13*a* and 13*b* of the twist gears 9*a* and 9*b*, respectively, for attachment of the barbed wire to the fence post by operation of the device motor 44. The method continues in like manner until the run of barbed wire is attached to each fence post which will support the fence.

While the preferred embodiments of the disclosure have been described above, it will be recognized and understood that various modifications can be made in the disclosure and the appended claims are intended to cover all such modifications which may fall within the spirit and scope of the disclosure.

What is claimed is:

1. A wire loading magazine for a twist attachment device, comprising:

a magazine assembly adapted to carry a supply of attachment wire segments, said magazine assembly including a clip trough and a wire loading clip having a wire segment dispensing slot carried by said clip trough and adapted to carry said supply of attachment wire segments, said clip trough communicating with said wire loading clip trough through said wire segment dispensing slot; and a wire loading assembly carried by said magazine assembly and adapted to individually and sequentially load said attachment wire segments from said magazine assembly into the twist attachment device, said wire loading assembly including at least one guide rod carried by said clip trough, an assembly knob slidably carried by said at least one guide rod and a wire engaging member carried by said assembly knob and disposed in said clip trough.

2. The wire loading magazine of claim 1 further comprising a magazine mount bracket and wherein said magazine assembly is carried by said magazine mount bracket.

3. The wire loading magazine of claim 2 wherein said magazine assembly is pivotally carried by said magazine mount bracket.

4. The wire loading magazine of claim 1 further comprising a wire segment guide communicating with said clip trough.

5. The wire loading magazine of claim 4 further comprising a wire segment stabilizing magnet communicating with said wire segment guide.

6. The wire loading magazine of claim 1 wherein said clip trough comprises a clip trough bottom, a pair of clip trough side walls extending from said clip trough bottom and a pair of clip trough end walls at respective ends of said clip trough bottom and said clip trough side walls.

7. A wire loading magazine for a twist attachment device, comprising:

a magazine assembly including:

a clip trough having a stanchion slot; and a wire loading clip having a wire segment dispensing slot carried by said clip trough and adapted to carry a supply of attachment wire segments, said clip trough communicating with said wire loading clip trough through said wire segment dispensing slot; and a wire loading assembly carried by said clip trough of said magazine assembly and including:

at least one guide rod carried by said clip trough;

an assembly return spring carried by said at least one guide rod;

an assembly knob slidably carried by said at least one guide rod and engaged by said assembly return spring;

a stanchion carried by said assembly knob and extending through said stanchion slot of said clip trough; and a wire engaging member carried by said stanchion in said clip trough and adapted to individually and sequentially load said attachment wire segments from said clip trough of said magazine assembly into the twist attachment device responsive to travel of said assembly knob along said at least one guide rod against said assembly return spring.

8. The wire loading magazine of claim 7 further comprising a magazine mount bracket and wherein said clip trough of said magazine assembly is carried by said magazine mount bracket.

9. The wire loading magazine of claim 8 wherein said clip trough of said magazine assembly is pivotally carried by said magazine mount bracket.

10. The wire loading magazine of claim 7 further comprising a wire segment guide communicating with said clip trough of said magazine assembly.

11. The wire loading magazine of claim 10 further comprising a wire segment stabilizing magnet communicating with said wire segment guide.

12. The wire loading magazine of claim 7 wherein said at least one guide rod comprises a pair of guide rods.

13. The wire loading magazine of claim 7 wherein said clip trough comprises a clip trough bottom, a pair of clip trough side walls extending from said clip trough bottom and a pair of clip trough end walls at respective ends of said clip trough bottom and said clip trough side walls and said stanchion slot extends through one of said clip trough side walls.

14. The wire loading magazine of claim 13 further comprising a pair of clip notches in said clip trough end walls, respectively, of said clip trough and a pair of clip tabs carried by said wire loading clip and seated in said clip notches, respectively.

15. A wire loading magazine for a twist attachment device, comprising:

a magazine mount bracket;

a magazine assembly including:

a generally elongated clip trough carried by said magazine mount bracket and having a clip trough bottom, clip trough side walls extending from said clip trough bottom, clip trough end walls at respective ends of said clip trough bottom and said clip trough side walls, a clip trough interior between said clip trough side walls and a stanchion slot in one of said clip trough side walls and communicating with said clip trough interior; and a wire loading clip having a clip bottom portion, clip side walls extending from said clip bottom portion, clip end walls at respective ends of said clip bottom portion and said clip side walls, a clip interior between said clip side walls and adapted to contain a supply of attachment wire segments, a clip cover carried by said clip side walls and a wire segment dispensing slot in said clip bottom portion, said clip trough interior of said clip trough communicating with said clip interior of said wire loading clip through said wire segment dispensing slot; and a wire loading assembly carried by said clip trough of said magazine assembly and including:

a wire loading assembly mount bracket carried by said clip trough;

at least one guide rod having a first end carried by said clip trough and a second end carried by said wire loading assembly mount bracket;

an assembly return spring carried by said at least one guide rod;

an assembly knob slidably carried by said at least one guide rod and engaged by said assembly return spring;

a stanchion carried by said assembly knob and extending through said stanchion slot of said clip trough; and a wire engaging member carried by said stanchion in said clip trough interior of said clip trough and adapted to individually and sequentially load said attachment wire segments from said clip trough interior of said clip trough into the twist attachment device responsive to travel of said assembly knob along said at least one guide rod against said assembly return spring.

16. The wire loading magazine of claim 15 further comprising a wire segment guide communicating with said clip trough interior of said clip trough.

17. The wire loading magazine of claim 16 further comprising a wire segment stabilizing magnet communicating with said wire segment guide.

18. The wire loading magazine of claim 15 further comprising a pair of clip notches in said clip trough end walls, respectively, of said clip trough and a pair of clip tabs carried by said wire loading clip and seated in said clip notches, respectively.

* * * * *